US006371593B1

(12) United States Patent
Li et al.

(10) Patent No.: US 6,371,593 B1
(45) Date of Patent: Apr. 16, 2002

(54) ERROR DETECTION AND CORRECTION FOR PRINTER POSITIONING LOGIC

(75) Inventors: Yung-Yi Li, Yung-Kang; Ben-Chuan Du, Hsin-Tien, both of (TW)

(73) Assignee: Acer Communication and Multimedia Inc., Taipei (TW)

( * ) Notice: Subject to any disclaimer, the term of this patent is extended or adjusted under 35 U.S.C. 154(b) by 0 days.

(21) Appl. No.: 09/754,222

(22) Filed: Jan. 5, 2001

(51) Int. Cl.[7] ..... B41J 21/16; B65H 7/02

(52) U.S. Cl. ..... 347/19; 347/37; 347/104; 400/279; 400/283; 400/708; 271/265.01

(58) Field of Search ..... 347/19, 37, 39, 347/16, 104; 400/279, 280, 281, 283, 583.2, 708; 271/3.14, 3.15, 3.16, 265.01; 318/602, 605, 661

(56) References Cited

U.S. PATENT DOCUMENTS 3,949,856 A * 4/1976 Ulber et al. ..... 400/579
5,241,525 A * 8/1993 Taylor ..... 370/394
5,598,201 A * 1/1997 Stodder et al. ..... 347/104
6,129,464 A * 10/2000 Nakamura et al. ..... 400/279
6,264,303 B1 * 7/2001 Watanabe ..... 347/37
6,267,466 B1 * 7/2001 Gudaitis et al. ..... 347/37
6,290,319 B1 * 9/2001 Boleda et al. ..... 347/19

FOREIGN PATENT DOCUMENTS

JP 11023323 A * 1/1999 ..... B41J/19/18

* cited by examiner

*Primary Examiner*—John Barlow
*Assistant Examiner*—Blaise Mouttet
(74) *Attorney, Agent, or Firm*—Winston Hsu

(57) ABSTRACT

A printer has a print path, a code strip disposed in parallel along the print path, a sensor for sensing the code strip, a driving system for moving the sensor along the code strip, a timer, a memory and a position signal generator. The code strip has embedded position information, which the sensor reads. The sensor generates a first or a second code signal depending upon the position of the sensor on the code strip. The timer generates clock signals at a rate that corresponds to an expected rate of change of the first and second signals from the sensor when the driving system moves the sensor along the code strip. The memory is used to hold the locations of defective areas on the code strip. The position signal generator uses the sensor to generate a position signal when the sensor is not reading within any of the defective areas on the code strip, and uses the clock signals from the timer to generate the position signal when the sensor is moving within any of the defective areas on the code strip.

18 Claims, 10 Drawing Sheets

ERROR DETECTION AND CORRECTION FOR PRINTER POSITIONING LOGIC

BACKGROUND OF THE INVENTION

1. Field of the Invention

The present invention relates to printer logic. More specifically, the present invention discloses a code strip print head position sensor with error detection and correction.

2. Description of the Prior Art

Accurate positioning of the print head within a printer is essential for ensuring the quality of a print job. Optical detecting systems are frequently used in printers to determine the position of the print head. Please refer to FIG. 1 and FIG. 2. FIG. 1 is a perspective view of a prior art printer 1. FIG. 2 is a function block diagram of the printer 1. The printer 1 comprises a print track 7 aligned along a left-and-right direction within the printer 1, as indicated by arrow RL. A carriage 9 slides along the print track 7, and carries a print cartridge 6. The print cartridge 6 is replaceable, and has a print head 3 that performs the actual printing operation. A driving system 2 moves the carriage 9, and thus the print head 3, left and right along the print track 7. Control circuitry 8 controls the operation of the printer 1, such as controlling the driving system 2 to move the carriage 9 left or right, and instructing the print head 3 to perform a printing operation. The printer 1 also has a print head position sensing system 4. The sensing system 4 sends signals to the control circuitry 8 to enable the control circuitry 8 to determine the position of the print head 3. The sensing system 4 comprises a code strip 4*a* and an optical detector 4*b*. The optical detector 4*b* sends pulses to the control circuitry 8 as the carriage 9 moves left or right. The pulses are based upon sensed regions on the code strip 4*a*.

Please refer to FIG. 3. FIG. 3 is a schematic diagram of the sensing system 4 and resultant sensing signals. The code strip 4*a*, running along the direction RL, is made from a series of alternating opaque regions 4*q* and transparent regions 4*t*. The opaque regions 4*q* and the transparent regions 4*t* all have a width w. The sensor 4*b* runs left and right along the code strip 4*a*, detecting the transparent regions 4*t* and opaque regions 4*q*, and comprises two optical sensors 4*y* and 4*z*. The optical sensors 4*y* and 4*z* both output a first signal (i.e., "high") when they detect a transparent region 4*t*, and output a second signal (i.e., "low") when they detect an opaque region 4*q*. The sensors 4*y* and 4*z* thus both output a square waveform that can be plotted against the code strip 4*a*. Waveform 10 corresponds to the output of the sensor 4*z* against the code strip 4*a*. Waveform 12 corresponds to the output of the sensor 4*y* against the code strip 4*a*. As the sensor 4*y* is separated from the sensor 4*z* by half the distance of the width w of the opaque and transparent regions 4*q* and 4*t* (i.e., by w/2), the waveforms 10 and 12 are exactly 90° out of phase with each other. The waveforms 10 and 12 are XORed together to form a positioning waveform 14. The positioning waveform 14 is used to determine the position of the print head 3, and has twice the effective resolution of the code strip 4*a*. With each transition of the positioning waveform 14, the control circuitry 8 increments or decrements a counter 8*a* depending upon the direction of motion of the carriage 6. The counter 8*a* thus holds a value that tracks the absolute position of the print head 3.

The above design is very effective at tracking the position of the print head 3. Unfortunately, it is not foolproof. Over time, the code strip 4*a* can become damaged. This damage will cause the sensors 4*y* and 4*z* to incorrectly read the code strip 4*a*, and lead to an incorrect positioning waveform 14.

An incorrect positioning waveform 14 leads to an improper printing process, which degrades the overall printing quality of the printer 1.

SUMMARY OF THE INVENTION

It is therefore a primary objective of this invention to provide a method and system for generating an error-corrected print head positioning signal.

The present invention, briefly summarized, discloses a method for generating an error-corrected print head positioning signal for a printer. The printer has a print path, a code strip disposed parallel to the print path, a sensor for sensing the code strip, a driving system for moving the sensor along the code strip, a timer, a memory and a position signal generator. The code strip has embedded position information, which the sensor reads. The sensor generates a first or a second code signal depending upon the position of the sensor on the code strip. The timer generates clock signals at a rate that corresponds to an expected rate of change of the first and second signals from the sensor when the driving system moves the sensor along the code strip. The memory is used to hold the locations of defective areas on the code strip. The position signal generator uses the sensor to generate a position signal when the sensor is not reading within any of the defective areas on the code strip, and uses the clock signals from the timer to generate the position signal when the sensor is moving within any of the defective areas on the code strip.

It is an advantage of the present invention that by using the clock signals to generate the position signals when the sensor is moving in a defective region of the code strip, the position signal generator ensures that the position signals closely correspond to the actual movement of the sensor along the code strip. When the sensor enters back into non-defective areas of the code strip, the signals from the sensor are then used, which re-synchronizes the position signals with the true position of the sensor on the code strip. The position signal generator thus ensures that a valid position signal is generated, leading to a more accurate printing process.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
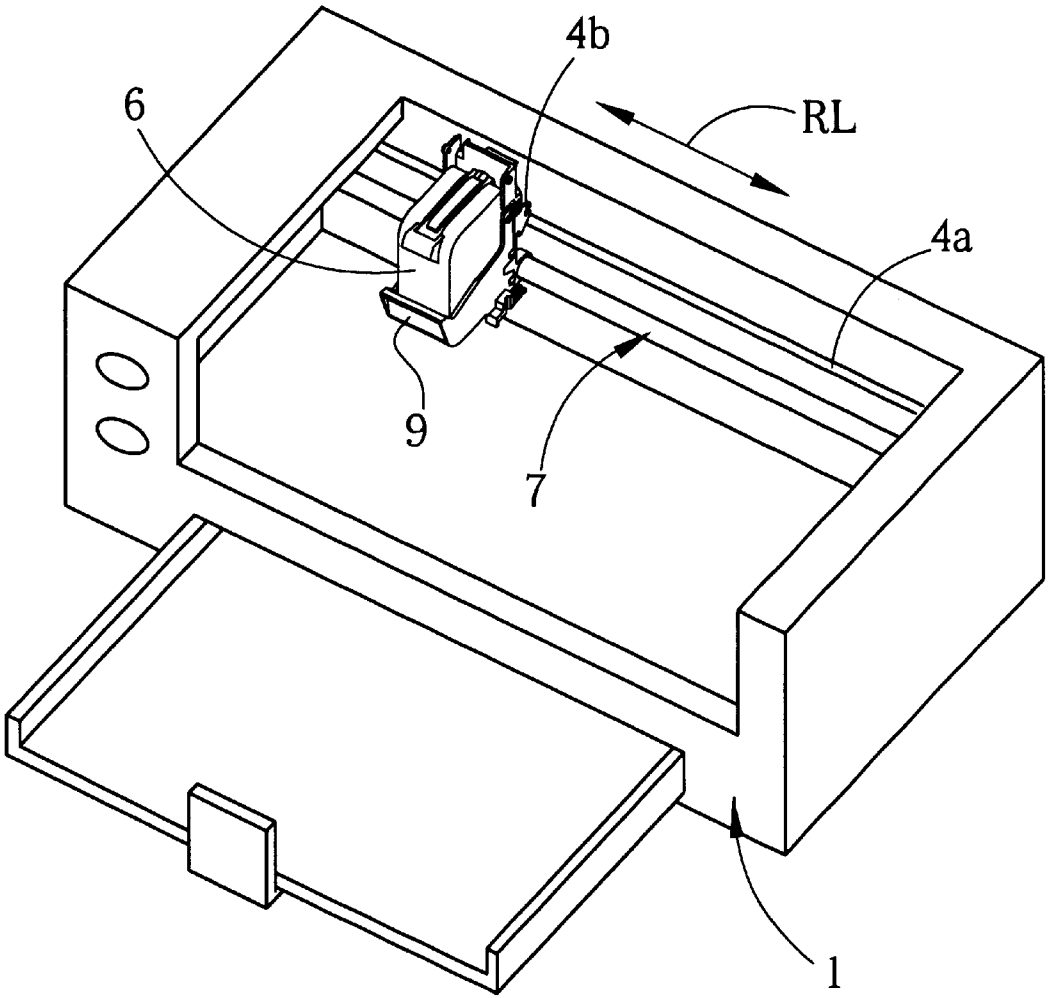
Fig. 1 Prior art
FIG. 1 is a perspective view of a prior art printer.
Figure 2:
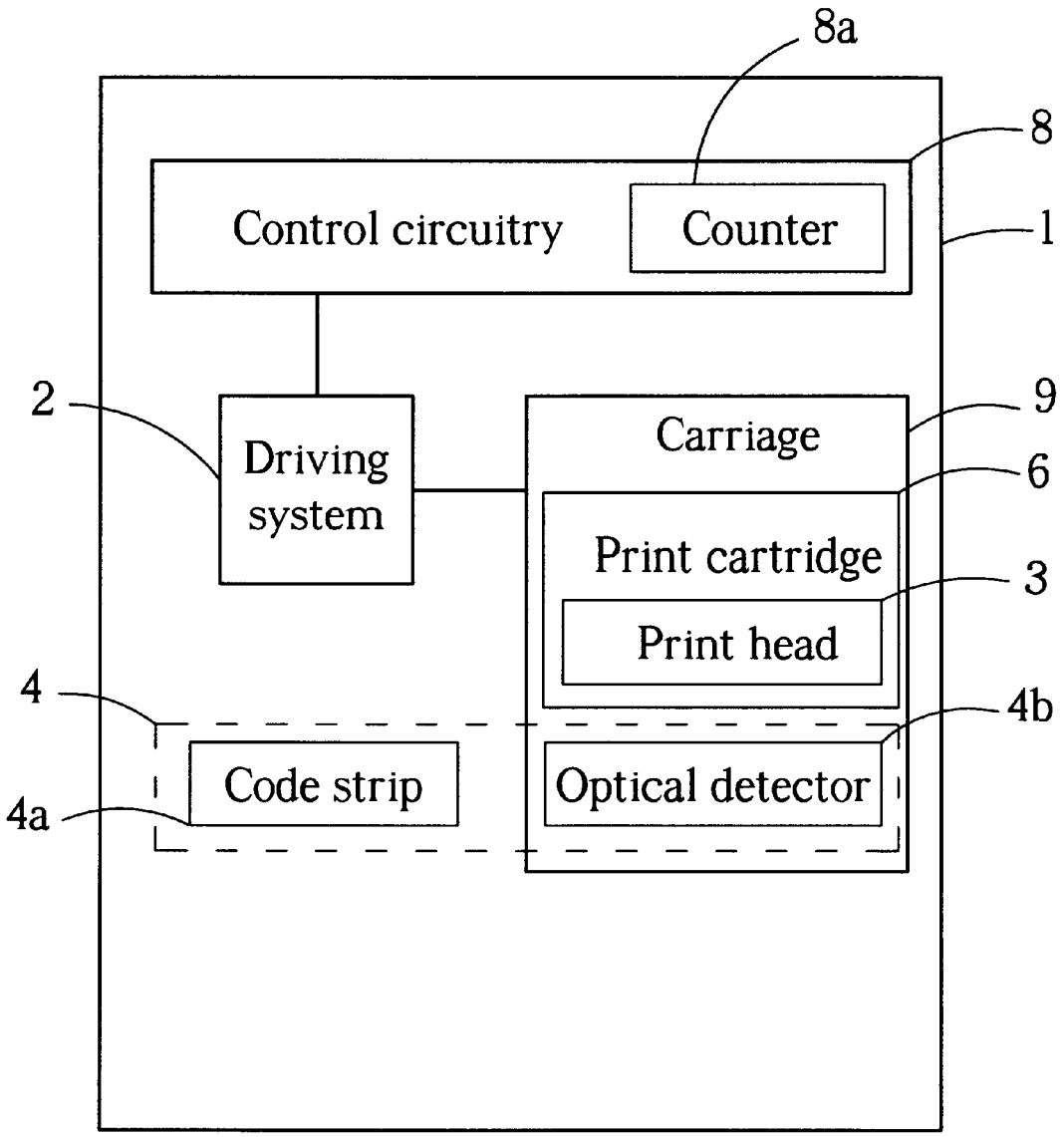
Fig. 2 Prior art
FIG. 2 is a function block diagram of the printer in FIG. 1.
Figure 3:
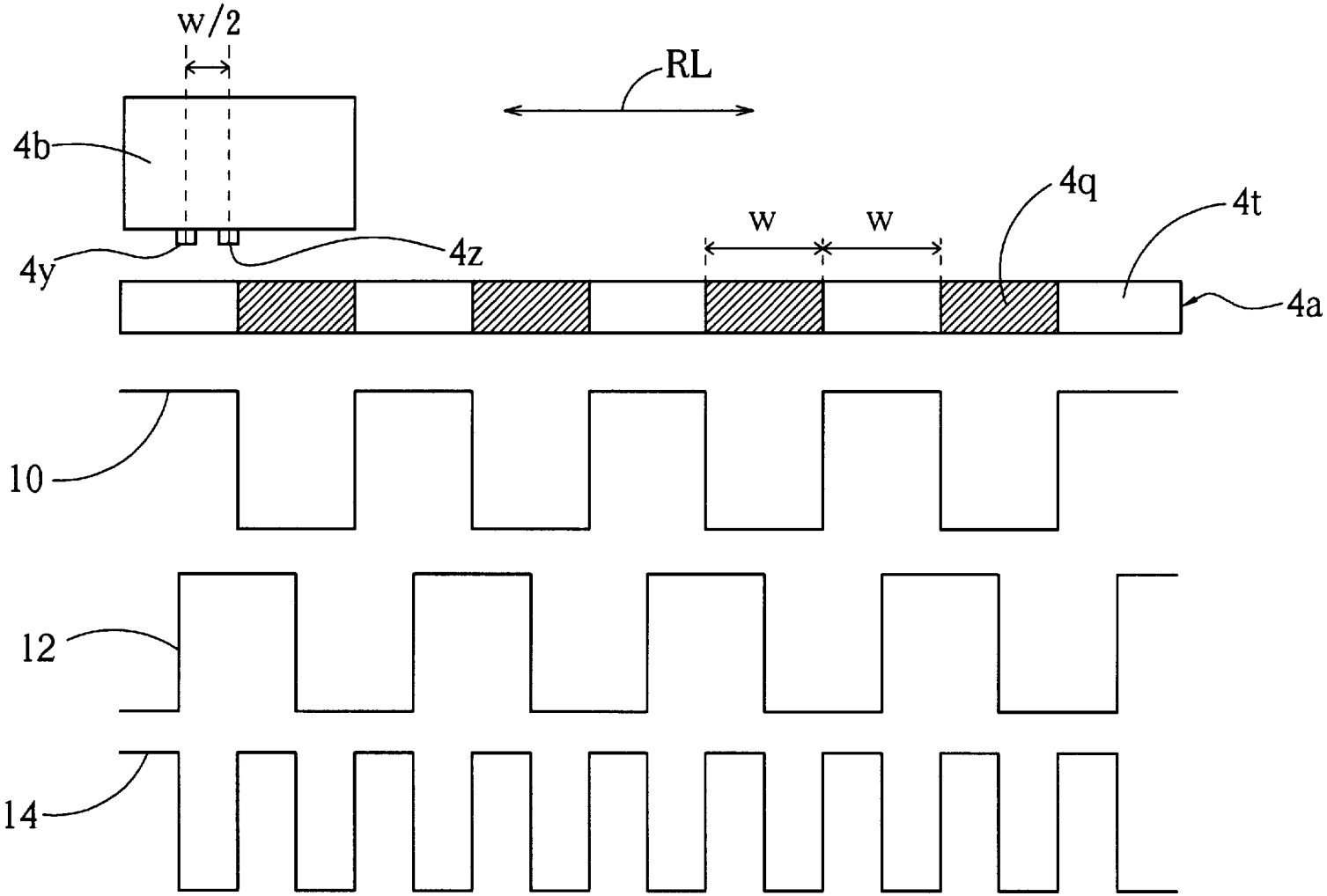
Fig. 3 Prior art
FIG. 3 is a schematic diagram of a prior art sensing system and resultant sensing signals.
Figure 4:
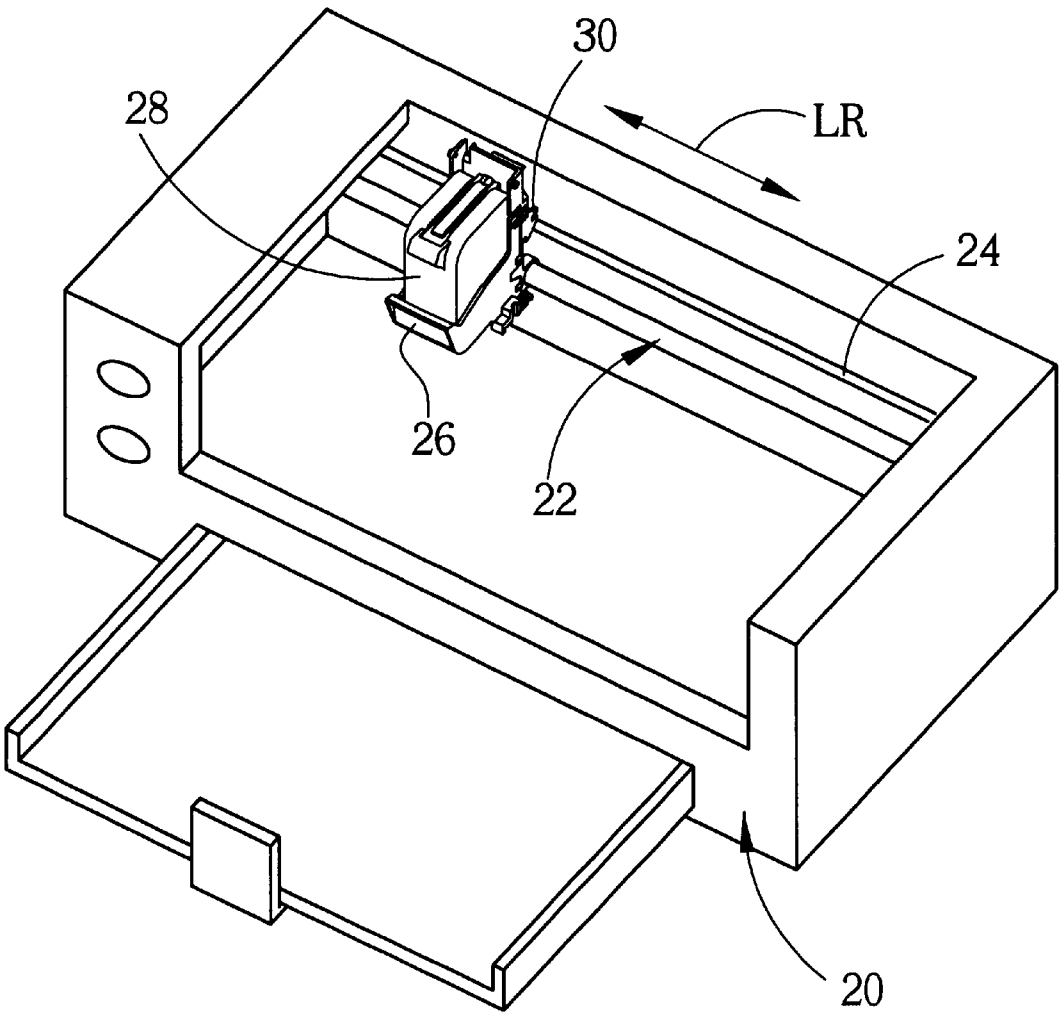
FIG. 4 is a perspective view of a printer according to the present invention.
Figure 5:
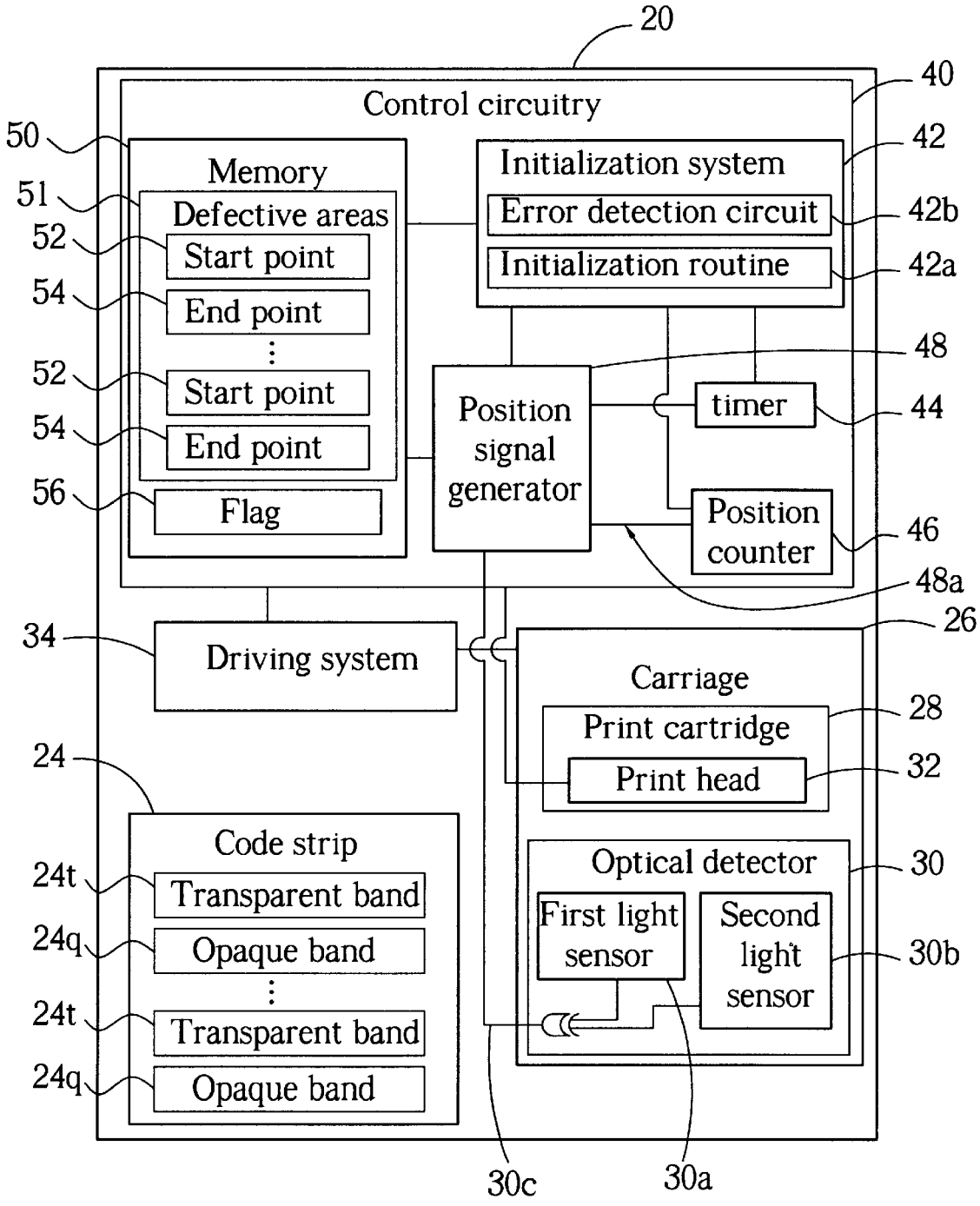
FIG. 5 is a function block diagram of the printer shown in FIG. 4.

Please refer to FIG. 4 and FIG. 5. FIG. 4 is a perspective view of a printer 20 of the present invention. FIG. 5 is a function block diagram of the printer 20. The printer 20 has a carriage 26 that is slidably disposed along a print track 22. The print track 22 runs along a left-and-right direction within the printer 20, as indicated by arrow LR. The carriage 26 is adapted to receive, and removably fix, a print cartridge 28. The print cartridge 28 is used to perform the actual printing process, and contains ink (not indicated) and a print head 32. The print head 32 jets ink onto a media (not shown) to form pixels, and by doing so thus performs a printing operation. A driving system 34 is mechanically connected to the carriage 26 and moves the carriage 26 left or right along the print track 22. The driving system 34 thus moves the print head 32 along the print track 22. Also mounted on the carriage 26 is an optical detector 30 for sensing a code strip 24. Please refer to FIG. 4 and FIG. 9. The code strip 24 is fixed parallel to the print track 22, and comprises a series of alternating opaque and transparent bands, 24*q* and 24*t* respectively. The transparent bands 24*t* and the opaque bands 24*q* all have the same width. The optical detector 30 comprises two optical sensors: a first optical sensor 30*a,* and a second optical sensor 30*b.* The optical sensors 30*a* and 30*b* are separated from each other along the LR direction by half the individual width of the transparent and opaque bands 24*t,* 24*q.* Each optical sensor 30*a* and 30*b* outputs a first signal when detecting a transparent band 24*t* (for example, a "high" signal), and outputs a second signal when detecting an opaque band (such as a "low" signal). The optical sensors 30*a* and 30*b* thus output waveforms that track the code strip 24 as the carriage 26 moves along the LR direction. The output waveform of the first optical sensor 30*a* is 90° out of phase with respect to the output of the second optical sensor 30*b* due to the precise separation between the two optical sensors 30*a* and 30*b.* The output waveforms of the first and second optical sensors 30*a* and 30*b* are XORed together to form an output 30*c* of the optical decoder 30.

The printer 20 also comprises control circuitry 40. The control circuitry 40 is in charge of the overall operations of the printer 20, and directs the operations of the driving system 34 and the print head 32. The control circuitry 40 receives the output 30*c* from the optical detector 30 to determine the current position of the print head 32. The control circuitry 40 comprises an initialization system 42, a timer 44, a position counter 46, a position signal generator 48, and a memory 50. The position counter 46 holds the absolute position of the print head 32. For example, if the print head 32 is all the way to the left on the print track 22, then the position counter 46 may hold a value of zero. Alternatively, if the print head 32 is all the way to the right on the print track 22, then the position counter may hold a value of 4500. Intermediate positions of the print head 32 would have corresponding intermediate values in the position counter 46. The position counter 46 is an edge-triggered counter that increments or decrements according to a position signal 48*a* received from the position signal generator 48. The position counter 46 increments when the control circuitry 40 is directing the driving system 34 to move the carriage 26 to the right, and similarly decrements when the carriage 26 moves to the left. The initialization system 42 is used to set the control circuitry 40 into a default state when the printer 20 is turned on or reset, and has an initialization routine 42*a* to perform this function. The initialization routine 42*a* may, for example, direct the driving system 34 to move the carriage 26 all the way to the left of the print track 22, and then clear the position counter 46. The initialization system 42 also has an error detection circuit 42*b* for detecting defective areas on the code strip 24.

The printer 20 is adapted to perform the method of the present invention, which includes:

(1) During initialization, scan the code strip 24 for any defective areas. If defective areas are found, record in the memory 50 their absolute starting points 52 and ending points 54.

(2) After initialization, when positioning the print head 32, such as during a printing process, use the output 30*c* from the optical detector 30 to control the position counter 46 when the optical detector 30 is not within any of the defective areas 51 stored in the memory 50.

(3) Otherwise, after initialization, when positioning the print head 32, use the output from the timer 44 to control the position counter 46 when the optical detector 30 is moving within any of the defective areas 51 stored in the memory 50.

The driving system 34 can move the carriage 26 with a substantially constant velocity. This constant velocity will result in a square wave signal coming from the output 30*c* of the optical detector 30. This square wave should have a substantially fixed frequency while the carriage 26 is moving. Consequently, any deviations in the frequency of the square wave 30*c* can be interpreted as the result of defective areas on the code strip 24. At the same time, the timer 44 is programmed to produce a square wave that has exactly the same frequency as that expected from the output signal 30*c* with a moving carriage 26.

Figure 6:
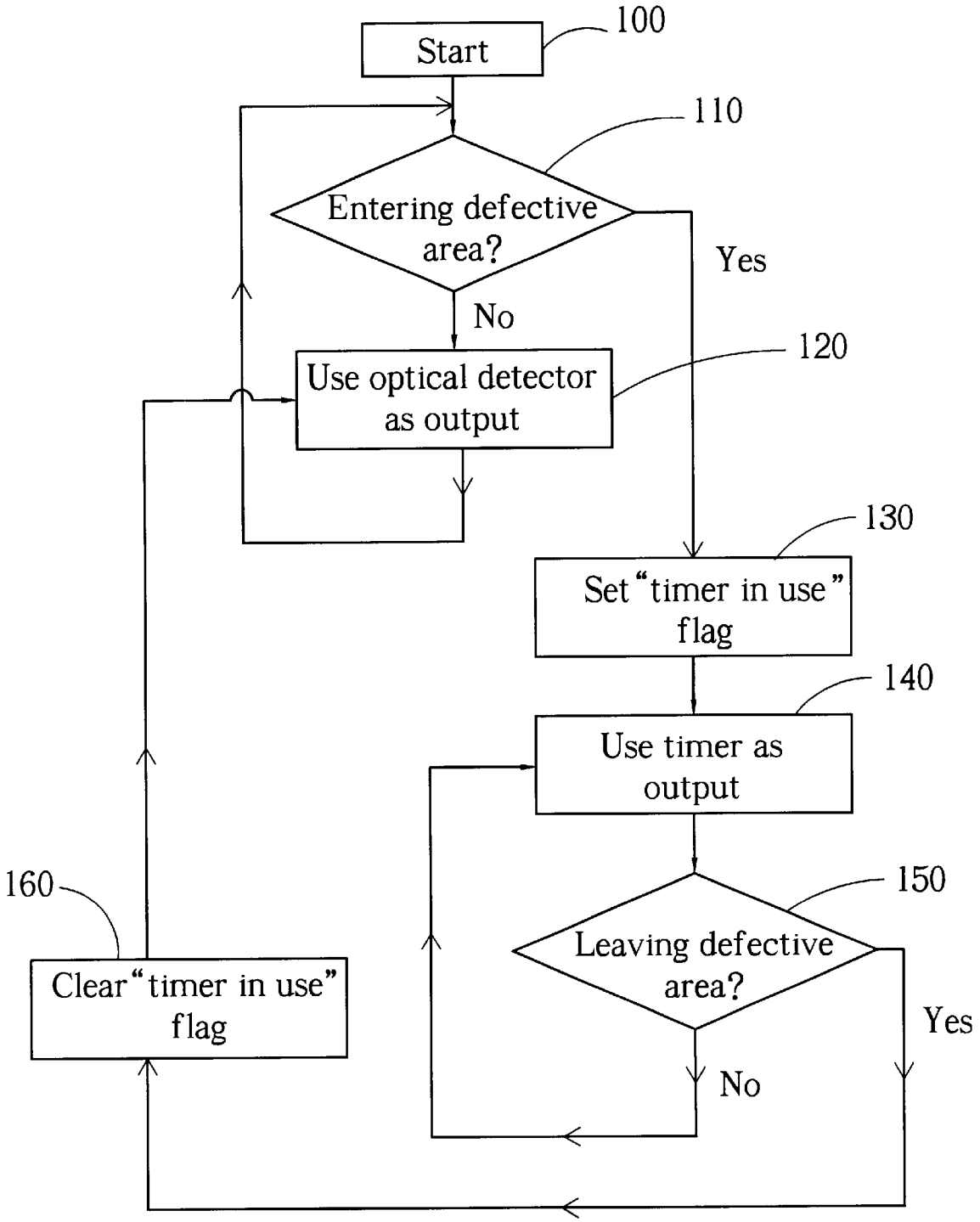
FIG. 6 is a flow chart for a position signal generator of the present invention after the printer of FIG. 4 has been initialized.

Please refer to FIG. 6 with reference to FIGS. 4 and 5. FIG. 6 is a flow chart for the position signal generator 48 after the printer 20 has been initialized. The position signal generator 48 is responsible for sending the counting signal 48*a,* which is essentially a square wave, to the position counter 46 to track the current position of the print head 32.

100: Start. The defective areas list 51 in the memory 50 have been filled.

110: Compare the current value of the position counter 46 with the start points 52 in the memory 50. If a start point 52 is found that matches the current value of the position counter 46 then proceed to step 130. Otherwise, proceed to step 120.

120: Use the output 30*c* from the optical detector 30 as the counting signal 48*a* for the position counter 46. Go to step 110.

130: Set the "timer in use" flag 56 in the memory 50 to TRUE. Proceed to step 140.

140: Use the output from the timer 44 as the counting signal 48*a* for the position counter 46. Proceed to step 150.

150: Compare the current value of the position counter 46 with the end points 54 in the memory 50. If an end point 54 is found that matches the current value of the position counter 46 then proceed to step 160. Otherwise, go to step 140.

160: Clear the "timer in use" flag 56 in the memory 50. Proceed to step 120.

The "timer in use" flag 56 is used to instruct the control circuitry 40 not to stop the driving system 34 from moving the carriage 26, or changing the direction of motion of the carriage 26. That is, while the optical detector 30 is within a defective region of the code strip 24, the driving system 34 must continue to move the carriage 26 at a steady rate through and beyond the defective area. Otherwise, if the carriage 26 were slowed or stopped while the optical detector 30 was in the defective area of the code strip 24, the timer 44, via the position signal generator 48, would continue to send counting pulses to the position counter 46. This would cause a steady accruement of error in the position counter 46 for the true position of the print head 32. Once the optical detector 30 is out of the defective area on the code strip 24, the flag 56 is set to FALSE. The optical detector is once again used as the input 48*a* for the position counter 46, and it is safe, then, to stop or reverse direction of the carriage 26.

From the above, it should be clear that the present invention uses the timer 44 instead of the optical detector 30 to trigger the position counter 46 when the optical detector 30 is in a defective area of the code strip 24. This is based on the fact that the frequency from the timer 44 is essentially identical to that of the output 30*c* coming from the optical detector 30 if there were no errors on the code strip 24. In order to insure this, though, the carriage 26 must be kept moving at a steady velocity. Furthermore, prior to entering the defective area on the code strip 24, the timer 44 should be in phase with the output signal 30*c* from the optical detector 30.

Figure 7:
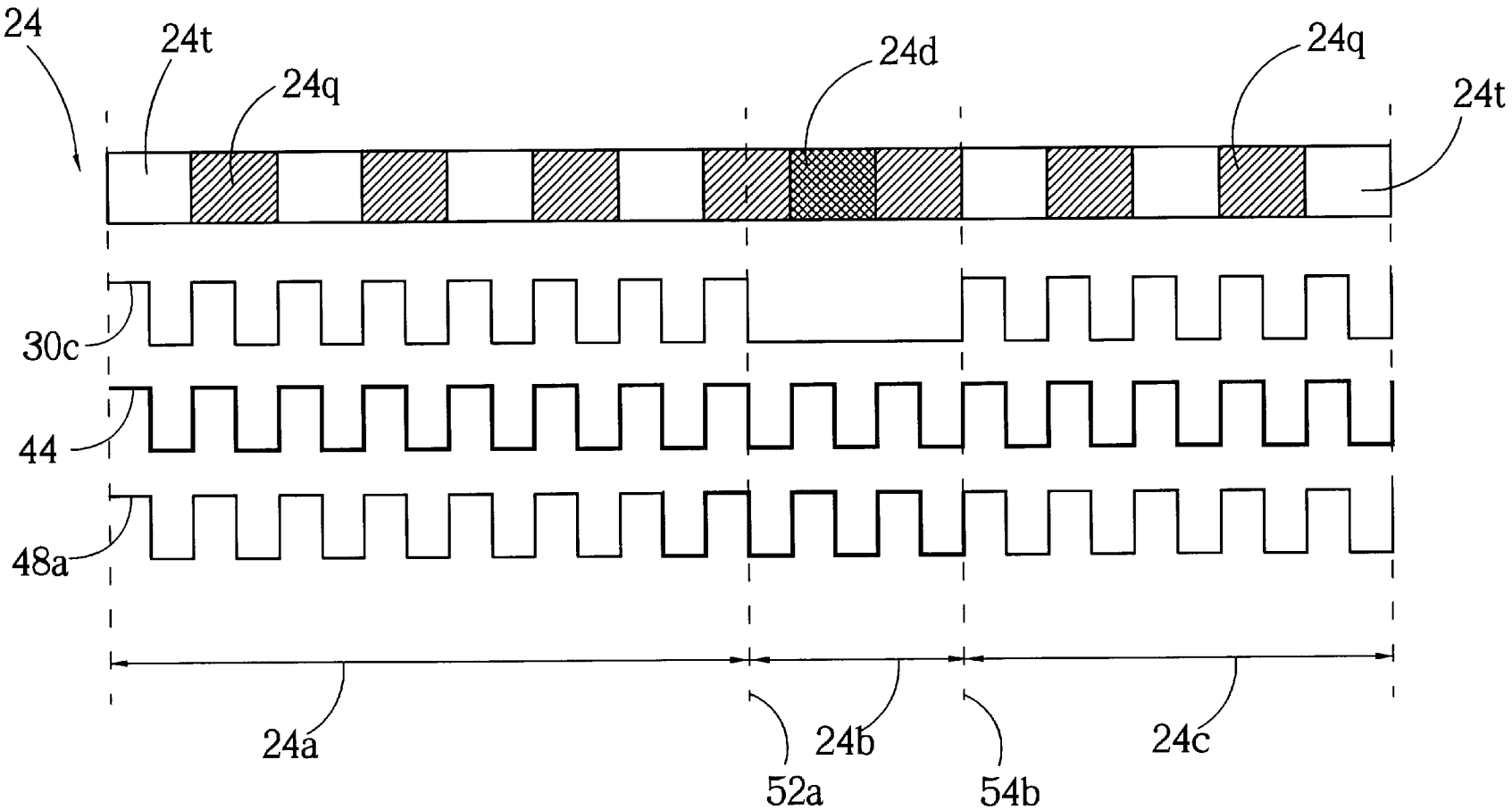
FIG. 7 is a diagram of a code strip with a defective region, and a resultant output of a position signal generator of the present invention.

To better understand the above, consider a specific example offered in FIG. 7, with reference to FIGS. 4 and 5. FIG. 7 is a diagram of the code strip 24 with a defective region 24*d,* and resultant output 48*a* of the position signal generator 48. The defective region 24*d* is read by the optical sensors 30*a* and 30*b* of the optical detector 30 as an opaque region 24*q,* though it should, instead, be a transparent region 24*t*. This could be due to ink on the region 24*d*. The output waveform 30*c* of the optical detector 30 has an incorrect shape from a starting point 52*a* to an ending point 54*b,* as shown in FIG. 7. The starting point 52*a* and ending point 54*b* are held in the defective areas list 51 of the memory 50. Thus, area 24*b* on the code strip 24 is considered a defective area. Within area 24*a,* the position signal generator 48 uses the output waveform 30*c* from the optical detector 30 as the input 48*a* for the position counter 46. Just prior to the defective area 24*b* starting point 52*a,* the control circuitry 40 ensures that the clock signal 44 is in phase with the output waveform 30*c*. At position 52*a,* the position signal generator 48 sets the flag 56 and uses the timer signal 44 as the input 48*a* for the position counter 46. The carriage 26 continues moving in a steady manner, passing through the defective region 24*b,* to the end point 54*b* and into a valid region 24*c*. At the end point 54*b,* the position signal generator 48 clears the flag 56 and again uses the output signal waveform 30*c* from the optical detector 30 as the input 48*a* for the position counter 46. The total resultant input waveform 48*a* for the position counter 46 closely matches what a "real" position waveform would be if there were no defective regions 24*d* on the code strip 24. The actual position of the print head 32 is thus accurately tracked by the position counter 46.

Figure 8:
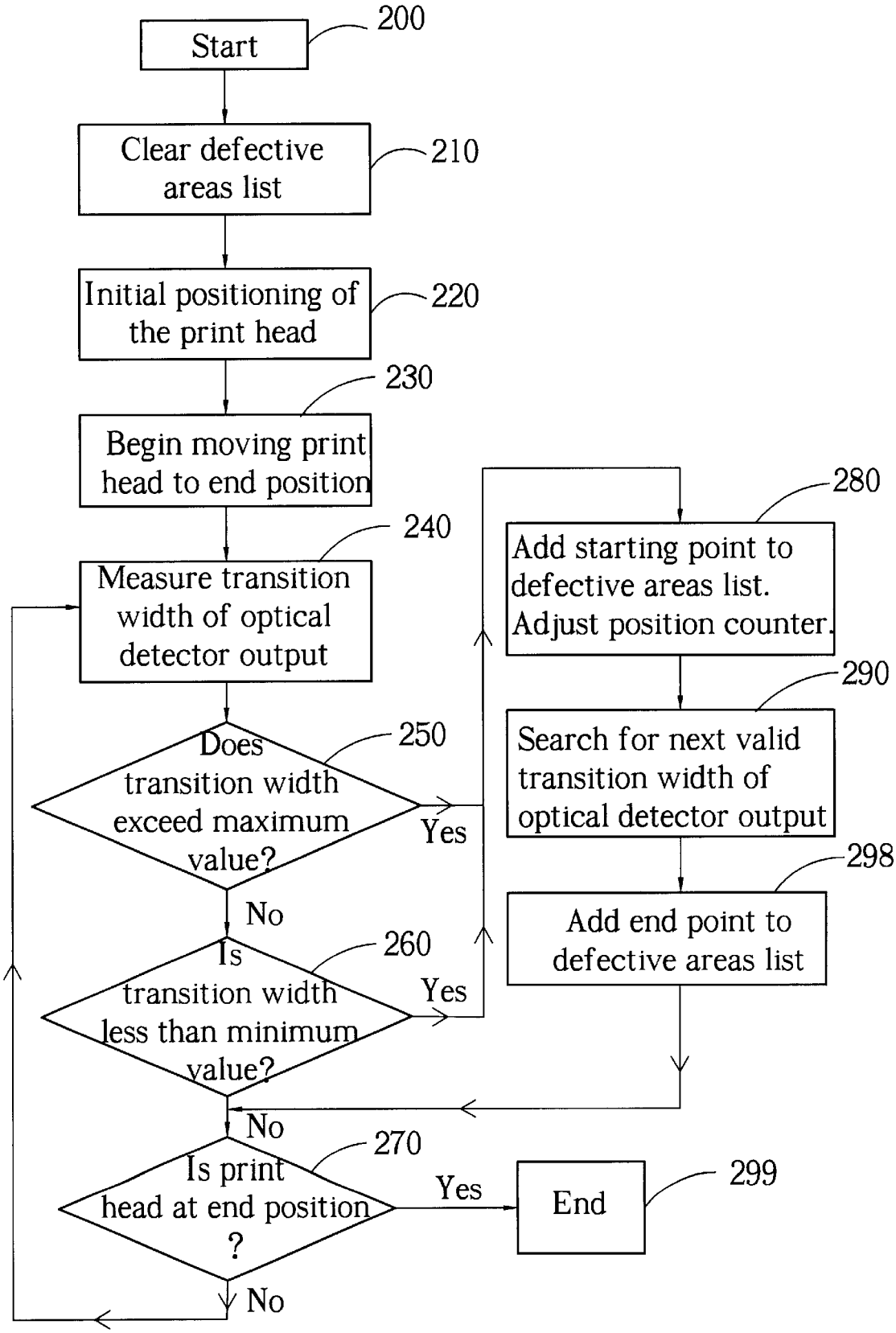
FIG. 8 is a flow chart for an initialization routine of a present invention printer.

During initialization, such as when the printer 20 is turned on or is reset, the initialization system 42 executes an initialization routine 42*a*. The initialization routine 42*a* uses an error detection circuit 42*b* to find the defective areas on the code strip 24. Please refer to FIG. 8 with respect to FIGS. 4 and 5. FIG. 8 is a flow chart for the initialization routine 42*a,* which has the following steps:

200: The initialization routine 42*a* begins to run.

210: The start points 52 and end points 54 in the defective areas list 51 are all set to a default value that indicates an empty entry. Such a value could be, for example, negative one (−1), or a value that exceeds the maximum width of the print track 22.

220: Direct the driving system 34 to move the carriage 26 to a farthest extreme point of the print track 22, such as the leftmost point of the print track 22. This point should be a little ahead of the code strip 34 so that the carriage 26 can accelerate up to its proper speed in step 230. Clear the position counter 46 so that it corresponds to the initial position of the print head 32.

230: Instruct the driving system 34 to begin moving the carriage 26 at a steady rate to the other end of the print track 22, such as the rightmost point of the print track 22. By the time the carriage 26 reaches the code strip 24, the carriage 26 should have accelerated up to a constant traveling velocity. Upon reaching the code strip 24, the output 30*c* of the optical detector 30 will begin outputting a square waveform.

240: The square waveform of the output 30*c* has low-to-high and high-to-low transitions. Synchronize the timer 44 with these transitions so that the timer 44 is in phase with the waveform of the output 30*c*. Instruct the position signal generator 48 to use the output 30*c* as the input 48*a* for the position counter 46. Measure the width of the low-to-high or the high-to-low transition of the output 30*c*. The error detection circuit 42*b* may have its own timer (not shown) dedicated for this function.

250: If the width measured in step 240 exceeds a maximum value, go to step 280. Otherwise, proceed to step 260.

260: If the width measured in step 240 is less than a minimum value, go to step 280. Otherwise, proceed to step 270.

270: If the print head 32 has reached the other extreme of the print track 22, such as the rightmost point of the print track 22, go to step 299. Otherwise, go to step 240.

280: Add the starting point obtained in step 240 to the list of defective areas 51 in the memory 50 as a start point 52. Adjust the position counter 46according to the timer 44. Instruct the position signal generator 48 to use the timer 44 as the input 48*a* for the position counter 46.

290: Continue measuring transition widths of the output 30*c* from the optical detector 30 until a transition having a valid width is found. The valid transition will have a starting point and an ending point.

298: Add the starting point of the valid transition found in step 290 to the list of defective areas 51 as an end point 54, thus completing a (start point 52, end point 54) pair in the memory 50. Go to step 270.

299: Scanning process of code strip 24 is complete. Return carriage 26 to starting point of print track 22 (i.e., the leftmost side of the print track 22). Zero position counter 46. Clear "timer in use" flag 56. Instruct the position signal generator 48 to use the output 30*c* from the optical detector 30 as the input 48*a* for the position counter 46.

In the above, the maximum and minimum width of a transition of the output 30*c* from the optical detector 30 may be set at 10% above and 10% below the expected transition width, respectively. That is, when designing and manufacturing the printer 20, the design of the driving system 34 of the printer 20 will determine what the transition rate of the output 30*c* should be if there are no defects on the code strip 24. This value is used as an expected transition width, and fixed percentages that are greater or less than this are used as boundary conditions for the measured transition width of the output 30*c*.

Figure 9:
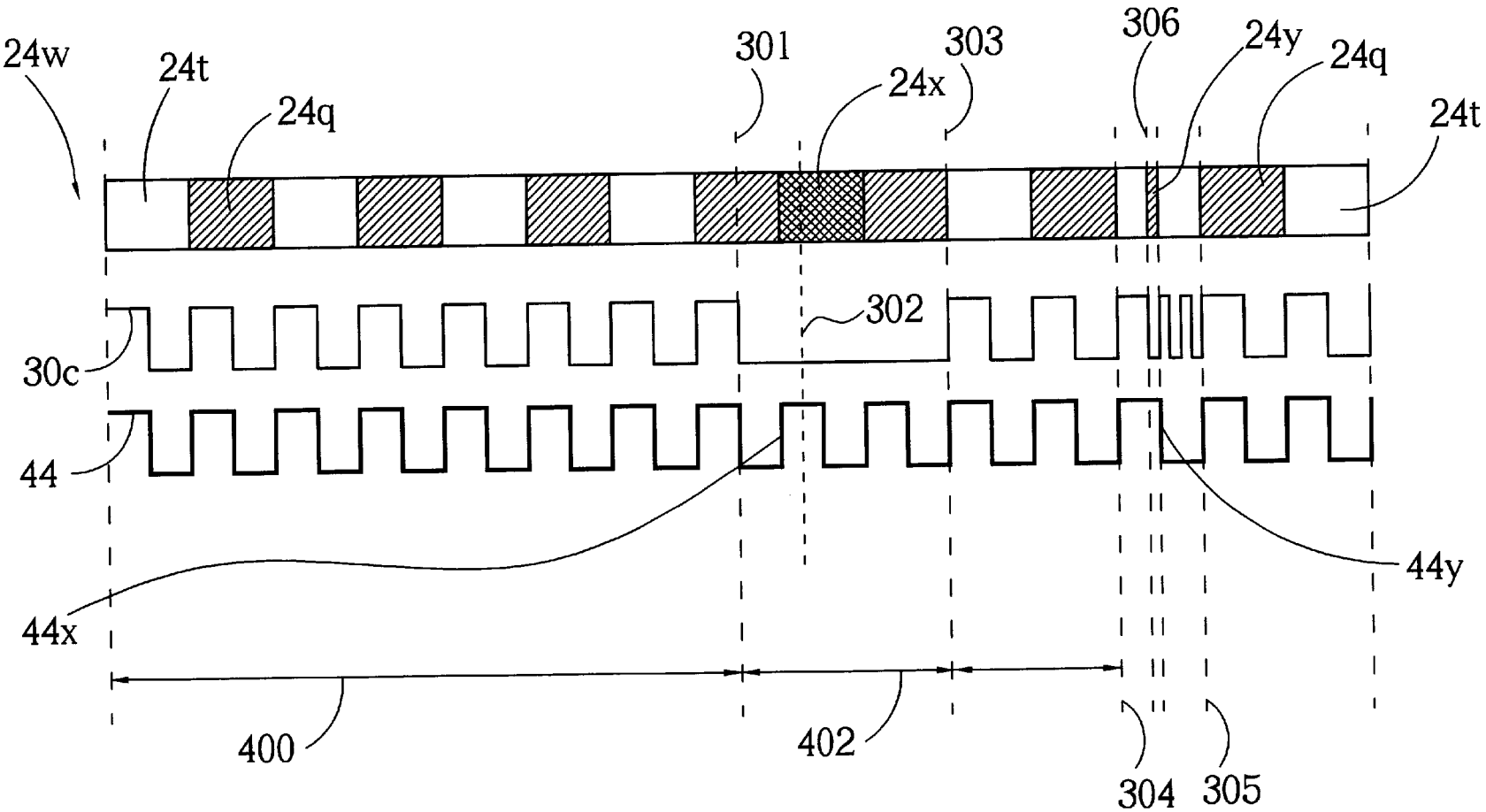
FIG. 9 is a diagram of a code strip with defective regions.

As an example of the above, please refer to FIG. 9. FIG. 9 is a diagram of a code strip 24*w* with a defective region 24*x* and another defective region 24*y*. The defective region 24*x* completely obscures one of the transparent regions 24*t*, whereas the defective region 24*y* only partially obscures a transparent region 24*t*. The resultant output 30*c* of the optical detector 30 is indicated below the code strip 24*w*. When the initialization routine 42*a* is run, the error detection circuit 42*b* first marks an error at position 301. Prior to position 301, within region 400, the position counter 46 is steadily incremented by the output 30*c*. However, at position 302, the error detection circuit 42*b* recognizes that output 30*c* has remained low for too long. The optical detector 30 has entered a defective area 402. The timer signal 44 is thus used to increment the position counter 46 after position 302. As an edge 44*x* in the timer signal 44 was missed, the position counter 46 must be incremented. Thereafter, it will be properly incremented by the timer signal 44. Position 301 is added to the defective areas list 51 as a start point 52. Upon reaching position 303, the error detection circuit 42*b* determines that the output 30*c* is now valid, and records position 303 as an end point 54 in the defective areas list 51. The output 30*c* is used to increment the position counter 46 as the optical detector 30 is now in a valid area. In a similar vein, the error detection circuit 42*b* will cause positions 304 and 305 to be entered as a start point 52 and endpoint 54, respectively, in the defective areas list 51. In this case, though, it is because the transitions of the output 30*c* are too rapid. Because an improper transition of the output 30*c* occurs at position 306 when the output 30*c* is used as the input 48*a* for the position counter 46, the position counter 46 must be decremented. Thereafter, the timer 44 will properly increment the position counter 46. Specifically, the edge 44*y* of the timer 44 will increment the position counter 46 at a time that properly corresponds to the position of the optical detector 30.

Figure 10:
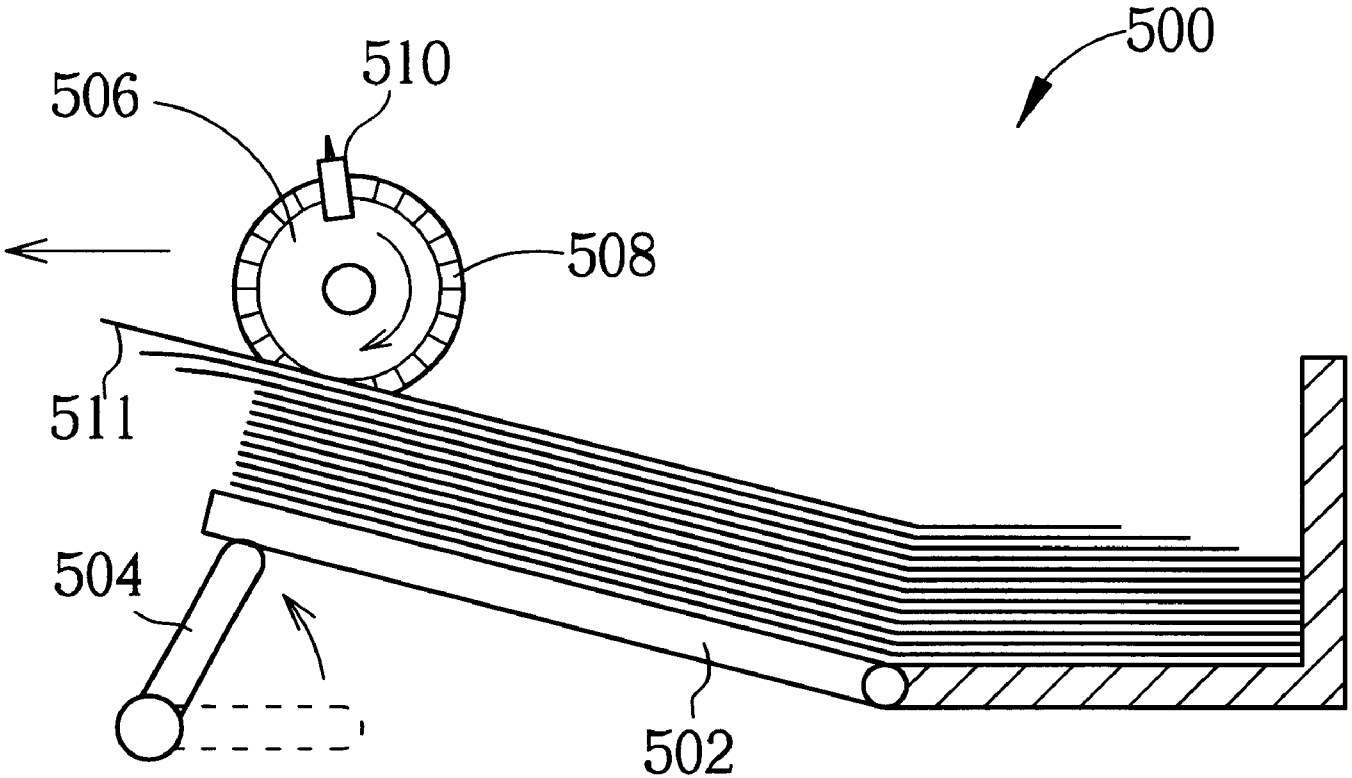
FIG. 10 is a diagram of a paper-feeding system utilizing the method of the present invention.

The error detection and correction method of the present invention can also be applied to code wheels. As a brief example of this, please consider FIG. 10. FIG. 10 is a diagram of a paper-feeding system 500. The paper-feeding system 500 comprises a rotatably mounted base plate 502, a lift cam 504, a feeding wheel 506, a code wheel 508 and a sensor 510. The lift cam 504 lifts the base plate 502 up, bringing a top sheet of paper 511 into contact with the feeding wheel 506. The rotation of the feeding wheel 506 draws out the top sheet 511, and feeds the top sheet 511 into an external device, such as a printer (not shown). Circumferentially mounted on the feeding wheel 506 is the code wheel 508. As the code wheel 508 rotates with the feeding wheel 506, the code wheel 508 moves by the sensor 510. The code wheel 508 rotates synchronously with the feeding wheel 506, thus a sensing wave pattern generated by the sensor 510 should also have a frequency that corresponds to the rotation of the feeding wheel 506. With reference to FIG. 5 and FIG. 10, as far as the control circuitry 40 is concerned, there is no difference between the signal 30*c* generated by the code strip optical detector 30, and a signal generated by the code wheel sensor 510. Both signals are essentially identical, and thus the control circuitry 40 could process either equally well. Hence, the control circuitry 40 could be used to detect errors on the code wheel 508, and to generate a corrected position value for the feeding wheel 506.

In contrast to the prior art, the present invention provides a detection system that scans the code strip for errors and records the defective areas on the code strip within a list in memory. A timer is also provided that provides a square wave timing signal with a frequency that corresponds to the frequency of the positioning signal coming from the code strip sensor when the sensor is moving across the code strip. When control circuitry determines that the sensor is moving into a defective area as recorded in the list, the timer is used to generate corrected positioning signals while the sensor moves through the defective area. When the sensor leaves the defective area, the control circuitry once again uses the positioning signals from the sensor as the true positioning signal.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A method for generating an error-corrected print head positioning signal for a printer, the printer comprising:

a code strip disposed along a left-and-right direction, the code strip having embedded position information;

a sensor for reading the embedded position information on the code strip and generating a corresponding positioning signal, the sensor slidable along the left-and-right direction;

a driving system for moving the sensor along the left-and-right direction; and a timer for generating clock signals at a regular rate, the rate of the clock signals corresponding to an expected rate of the positioning signals from the sensor when the driving system moves the sensor;

the method comprising:

detecting errors on the code strip to find flawed areas on the code strip and to generate a list of flawed areas on the code strip; using the sensor to generate a corrected positioning signal when the sensor is not reading within any of the flawed areas on the code strip; and using the clock signals from the timer to generate the corrected positioning signal when the sensor is moving within any of the flawed areas on the code strip.

2. The method of claim 1 wherein the code strip comprises a starting point and an ending point, and detecting errors on the code strip comprises:

clearing the list of flawed areas on the code strip;

using the driving system to move the sensor to the starting point;

using the driving system to move the sensor to the ending point; and measuring a time interval between a first positioning signal from the sensor at a first position on the code strip and a second positioning signal from the sensor at a second position on the code strip as the sensor moves from the starting point to the ending point;

wherein if the time interval exceeds a first valid value or is less than a second valid value then an area on the code strip between the first position and the second position is determined to be a flawed area, and the flawed area is added to the list of flawed areas on the code strip.

3. The method of claim 1 wherein the code strip comprises regularly spaced transparent and opaque bands, the sensor is an optical sensor for sensing the transparent and opaque bands, and the sensor generates a first signal indicating the transparent bands and a second signal indicating the opaque bands.

4. A printer comprising:

a print path disposed along a left-and-right direction;

a code strip disposed along the print path, the code strip comprising embedded position information;

a sensor slidably disposed along the code strip for reading the embedded position information on the code strip and generating a first signal or a second signal according to the position of the sensor on the code strip;

a driving system for moving the sensor along the code strip;

a timer for generating clock signals at a regular rate, the rate of the clock signals corresponding to an expected rate of change of the first and second signals from the sensor when the driving system moves the sensor;

a memory for holding a list of flawed areas on the code strip; and a position signal generator for generating a position signal;

wherein the position signal generator uses the first signal and the second signal from the sensor to generate the position signal when the sensor is not reading within any of the flawed areas recorded in the list of flawed areas on the code strip held in the memory, and uses the clock signals from the timer to generate the position signal when the sensor is moving within any of the flawed areas recorded in the list of flawed areas on the code strip held in the memory.

5. The printer of claim 4 wherein the position signal is used as an input for an edge-triggered counter for incrementing or decrementing a position number held within the edge-triggered counter, the position number corresponding to the position of the sensor on the code strip.

6. The printer of claim 5 wherein the list of flawed areas on the code strip comprises a plurality of entries, each entry comprising a first position number and a second position number, the first position number corresponding to a starting point on the code strip of a defective area, the second position number corresponding to an ending point on the code strip of the defective area.

7. The printer of claim 4 further comprising an error detection circuit for detecting a defective area on the code strip and adding the defective area to the list of flawed areas on the code strip in the memory.

8. The printer of claim 7 wherein when the printer performs an initialization routine, the initialization routine uses the error detection circuit to find any defective areas on the code strip and to create the list of flawed areas on the code strip.

9. A printing apparatus comprising:

a print path disposed along a left-and-right direction;

a code strip disposed along the print path, the code strip having embedded position information;

a print cartridge having a print head for performing printing operation, the print cartridge is capable of moving along the print path at a substantially constant velocity;

a sensor disposed on the print cartridge for reading the embedded position information on the code strip and generating first signals;

a timer for generating clock signals at a rate corresponding to an expected rate of the first signals when the print cartridge moves along the print path at a substantially constant velocity;

a memory for holding a list of flawed areas on the code strip; and a position signal generator for generating a position signal;

wherein the position signal generator uses the first signals from the sensor to generate the position signal when the sensor is not reading within any of the flawed areas recorded in the list of the flawed areas on the code strip held in the memory, and uses the clock signals from the timer to generate the position signal when the sensor is reading within any of the flawed areas recorded in the list of flawed areas on the code strip held in the memory.

10. The printer of claim 9 wherein the position signal is used as an input for an edge-triggered counter for incrementing or decrementing a position number held within the edge-triggered counter, the position number corresponding to the position of the sensor on the code strip.

11. The printer of claim 9 wherein the list of flawed areas on the code strip comprises a plurality of entries, each entry comprising a first position number and a second position number, the first position number corresponding to a starting point on the code strip of the defective area, the second position number corresponding to an ending point on the code strip of the defective area.

12. The printer of claim 9 further comprising an error detection circuit for detecting a defective area on the code strip and adding the defective area to the list of flawed areas on the code strip in the memory.

13. The printer of claim 12 wherein when the printer performs an initialization routine, the initialization routine uses the error detection circuit to find any defective areas on the code strip and to create the list of flawed areas on the code strip.

14. A paper-feeding mechanism comprising:

a rotating element adapted for feeding paper;

a code wheel disposed on the rotating element, the code wheel having embedded position information and the code wheel capable of rotating synchronously with the rotating element;

a sensor for sensing the embedded position information on the code wheel and generating first signals;

a timer for generating clock signals at a rate corresponding to an expected rate of the first signals when the rotating element feeds the paper;

a memory for holding a list of flawed areas on the code wheel; and a position signal generator for generating a position signal;

wherein the position signal generator uses the first signals from the sensor to generate the position signal when the sensor is not reading within any of the flawed areas recorded in the list of the flawed areas on the code wheel held in the memory, and uses the clock signals from the timer to generate the position signal when the sensor is reading within any of the flawed areas recorded in the list of flawed areas on the code wheel held in the memory.

15. The paper-feeding mechanism of claim 14 wherein the position signal is used as an input for an edge-triggered counter for incrementing or decrementing a position number held within the edge-triggered counter, the position number corresponding to a rotational position of the code wheel with respect to the sensor.

16. The paper-feeding mechanism of claim 14 wherein the list of flawed areas on the code wheel comprises a plurality of entries, each entry comprising a first position number and a second position number, the first position number corresponding to a starting point on the code wheel of the defective area, the second position number corresponding to an ending point on the code wheel of the defective area.

17. The paper-feeding mechanism of claim 14 further comprising an error detection circuit for detecting a defective area on the code wheel and adding the defective area to the list of flawed areas on the code wheel in the memory.

18. The paper-feeding mechanism of claim 17 wherein when the paper-feeding mechanism performs an initialization routine, the initialization routine uses the error detection circuit to find any defective areas on the code wheel and to create the list of flawed areas on the code wheel.

* * * * *